US006742858B2

(12) United States Patent
Lehmkuhl et al.

(10) Patent No.: US 6,742,858 B2
(45) Date of Patent: Jun. 1, 2004

(54) LABEL PRINTER-CUTTER WITH MUTUALLY EXCLUSIVE PRINTING AND CUTTING OPERATIONS

(75) Inventors: Wade E. Lehmkuhl, Bloomington, MN (US); Scott C. Milton, Maplewood, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 113 days.

(21) Appl. No.: 09/683,714

(22) Filed: Feb. 6, 2002

(65) Prior Publication Data

US 2003/0146943 A1 Aug. 7, 2003

(51) Int. Cl.[7] ..... B41J 2/165; B41J 3/00; B41J 2/01; B41J 31/00; B41J 11/26

(52) U.S. Cl. ..... 347/24; 327/2; 327/104; 327/213; 327/214; 400/621

(58) Field of Search ..... 347/2, 24, 103, 347/104, 193, 213, 217, 212; 400/208, 621

(56) References Cited

U.S. PATENT DOCUMENTS

| | | | | |
|---|---|---|---|---|
| 3,761,675 A | * | 9/1973 | Mason et al. | 219/121 LM |
| 5,078,523 A | | 1/1992 | McGourty et al. | 400/613 |
| 5,138,341 A | | 8/1992 | Kobayashi | 346/136 |
| 5,157,761 A | | 10/1992 | Hawkes | 395/107 |
| 5,163,675 A | | 11/1992 | Sunohara | 271/274 |
| 5,188,009 A | | 2/1993 | Sunohara et al. | 83/13 |
| 5,202,958 A | | 4/1993 | Kobayashi | 395/102 |
| 5,275,077 A | | 1/1994 | Kobayashi | 83/880 |
| 5,318,370 A | | 6/1994 | Nehowig | 400/613 |

(List continued on next page.)

OTHER PUBLICATIONS

Brochure—Brady® Make–It–Yourself Products, It's Important to use the Right Tool for the Right Job, Brady Worldwide, Inc., 1999.

Brochure—Brady® Graphic Solutions, GraphicsPro™ Label & Sign Creator Offers the Convenience of Custom Labels and Signs at the Touch of a Fingertip, W.H. Brady Co./Brady USA, Inc., 1997.

Brochure—Impressa 2 digital label & decal press, Print and Cut Your Own Full–Color Labels and Decals in any Size or Shape!, pp. 1–6, Primera Technology, Inc., 1998.

Brochure—ColorCAMM PRO Versatility, Roland DGA Corporation, 2000.

Brochure—The Future of Sign Making is here, Gerber Edge, Gerber Scientific Products, Inc., 1994.

*Primary Examiner*—Stephen D. Meier
*Assistant Examiner*—Alfred Dudding
(74) *Attorney, Agent, or Firm*—Whyte Hirschboeck Dudek SC

(57) ABSTRACT

A label printer-cutter includes a frame and a print head assembly connected to the frame. The print head assembly includes a print head for printing to a label media. The label printer-cutter includes a cutting assembly connected to the frame, and the cutting assembly is for catting the label media. The printer-cutter also includes a controller in operative association with the print head assembly and cutting assembly. The controller can be programmed to control the print head assembly and the cutting assembly such that printing to and cutting of the label media does not occur simultaneously in the label printer-cutter. Printing by the print head is controlled to correspond to cutting assembly rollers being positioned in a non-cutting position. Advantageously, printing to and cutting of a label media in a single label printer-cutter unit is accomplished in an efficient and cost-effective manner.

51 Claims, 11 Drawing Sheets

U.S. PATENT DOCUMENTS 5,441,352 A * 8/1995 Shiota ..... 400/621
5,451,996 A * 9/1995 Awai et al. ..... 347/214
5,497,183 A * 3/1996 Yoshida et al. ..... 347/215
5,511,891 A 4/1996 Nehowig et al. ..... 400/583
5,755,519 A 5/1998 Klinefelter ..... 400/249
5,823,689 A 10/1998 Nehowig et al. ..... 400/83
5,823,692 A 10/1998 Tolrud et al. ..... 400/582
5,887,993 A 3/1999 Nunokawa et al. ..... 400/208
6,007,263 A 12/1999 Imai et al. ..... 400/693
6,008,831 A 12/1999 Nakanishi et al. ..... 347/195
6,034,705 A 3/2000 Tolle et al. ..... 347/195
6,042,279 A 3/2000 Ackley ..... 400/103
6,046,756 A 4/2000 Iga et al. ..... 347/173
6,099,178 A 8/2000 Spurr et al. ..... 400/207
6,112,658 A 9/2000 Gunther et al. ..... 101/171
6,149,325 A 11/2000 Nunokawa et al. ..... 400/208
6,201,256 B1 3/2001 Kouchi et al. ..... 250/559.44
6,213,659 B1 4/2001 Elgee ..... 400/633
6,246,050 B1 6/2001 Tullis et al. ..... 250/231.13
6,249,302 B1 6/2001 Sekiya ..... 347/220
6,264,296 B1 7/2001 Klinefelter et al. ..... 347/4
6,264,774 B1 7/2001 Lenz et al. ..... 156/64
6,266,075 B1 7/2001 Feitel et al. ..... 347/198
D446,544 S 8/2001 Platner et al. ..... D18/50
6,270,858 B1 8/2001 Paulson ..... 427/508
6,276,849 B1 8/2001 Feitel et al. ..... 400/242

* cited by examiner

LABEL PRINTER-CUTTER WITH MUTUALLY EXCLUSIVE PRINTING AND CUTTING OPERATIONS

FIELD OF THE INVENTION

The present invention relates generally to printing to and cutting of a label media using a label printer-cutter. In one aspect, the invention relates to a label printer that includes a print head assembly for printing to a label media and a cutting assembly for cutting of a label media such that the printing and cutting are mutually exclusive.

BACKGROUND OF INVENTION

Electronic label printing machines are often used to generate adhesive labels having images (e.g., indicia, graphics, art, specialized instructions, warnings, slogans, advertising, etc.) to facilitate identification, tracking and pricing of goods. Such label printers typically include: a print head, an assembly (e.g., a label media cartridge) for conveniently supplying or inserting a label media (also called a label media supply) into the printer so that the label media can be fed past the print head in order to be printed, a microprocessor, a read-only memory (ROM) programmed with appropriate instructions therein to operate the microprocessor, a random access memory (RAM), a keyboard with letter, number, and function keys for entry of alphanumeric information requisite to printing the indicia on the label media, and a visual display such as a light emitting diode ("LED") or liquid crystal display ("LCD") screen to convey information to a machine operator. These components function together to achieve the end goal of creating high quality and accurate labels from the label media using the electronic label printing machine.

Labels are made from a label media. The label media itself typically is made up of a roll of pressure sensitive tape that is attached, typically along a side containing an adhesive, to a continuous support roll of release liner material. The label media is fed in a media direction along a media path through the label printer. Discrete labels are formed by cutting the label media. Complex label shapes can be obtained by plotter cutting the tape layer only of the label media. The label media can be end cut (i.e., cutting through the tape and the release liner layers) or portioned into an end cut label media portion in order to obtain as many discrete labels in a continuous row as is desired. In other words, one or more than one discrete label can reside on an end cut label media portion. An end cutting operation can occur with or without a plotter cutting operation first having taken place. Following label media cutting, the discrete labels can be removed from the release liner and attached, as appropriate, to the particular application requiring identification. Since there are many types of label applications, there are many combinations of tape and release liners that can provide labels of varying sizes, colors, formats, and characteristics.

One type of label printer employs a thermal transfer print head. In general, the use of thermal print heads in label printers has increased as the quality and accuracy of thermal print heads has improved. Thermal transfer printing uses a heat-generating print head to transfer ink, or the like, from a thermal transfer ribbon to a label media to form a label image on the media. A microprocessor determines a sequence of individual thermal, typically resistive, print head elements to be selectively heated or energized. Energizing the sequence of elements in turn heats the ribbon so as to transfer the ink from the ribbon, creating the desired image on the label media, and specifically, on the label tape. The label printer can be fed label media from a label media source. Simultaneously, a thermal transfer ribbon can be fed from a ribbon source. While the label media runs between the print head and a support (platen) roller, the transfer ribbon can run between the print head and the support roller. Thus, the label media and the transfer ribbon can run together in an overlay relationship between the print head and the support roller.

When it is desired to print a color image on a label media, it is generally required to print the image by passing the label media several times past the print head. To accomplish each pass, the label media is fed, retracted, and then re-fed again past the thermal print head. With each pass, a different primary color, for example, in a traditional color scheme, cyan, magenta, yellow, and black, is printed from a continuous ink ribbon onto the label media using the print head. In this manner, based on the amount of each color printed, a composite color image can be printed onto a label media.

It is continually desirable to improve the functionality, performance and/or efficiency of various components, or combinations of components (also sometimes called "assemblies" or "subassemblies") that make up label printers. For example, it would be desirable to improve the process of cutting label media in label printers.

It has been found to be convenient to provide both printing to and cutting of a label media in a single unit. As a result, independent printing and cutting systems or assemblies are typically required to accomplish these operations. Transferring from printing to cutting operations in a single label printer-cutter unit has required complex systems with large numbers of components. As a result, such printer-cutters have tended to be difficult and costly to manufacture.

Thus, it would be advantageous to accomplish printing to and cutting of a label media in a single label printer-cutter unit, and moreover, to do so in an efficient and cost-effective manner.

SUMMARY OF INVENTION

The present invention generally provides a label printer-cutter with mutually exclusive printing and cutting operations that overcomes the aforementioned problems.

Disclosed herein is a label printer-cutter comprising: a frame; a print head assembly connected to the frame, the print head assembly including a print head for printing to a label media; a cutting assembly connected to the frame, the cutting assembly for cutting of the label media; and a controller in operative association with the print head assembly and the cutting assembly; wherein the controller can be programmed to control the print head assembly and the cutting assembly such that printing to and cutting of the label media does not occur simultaneously in the label printer-cutter.

Also, a method is disclosed for selectively printing to and cutting of a label media in a label printer-cutter. The method includes: printing to a label media using a print head assembly, cutting the label media using the cutting assembly, and using a controller that is in operable association with the print head assembly and the cutting assembly to control the print head assembly and the cutting assembly such that printing to and cutting of the label media does not occur simultaneously in the label printer-cutter.

Various other features, objects and advantages of the present invention will be made apparent from the following detailed description and the drawings.

BRIEF DESCRIPTION OF DRAWINGS

Preferred embodiments of the invention are described below with reference to the following drawings, which are provided for illustrative purposes only. The drawings illustrate a best mode presently contemplated for carrying out the invention.

In the drawings.

DETAILED DESCRIPTION OF THE PREFERRED EMBODIMENTS

In the following detailed description, references are made to the accompanying drawings which form a part of this application, and in which is shown by way of illustration specific embodiments in which the invention can be practiced. These embodiments are described in sufficient detail to enable those skilled in the art to practice the invention, and it is to be understood that other embodiments can be utilized and that various changes can be made without departing from the spirit and scope of the present invention. Moreover, in the detailed description, like numerals are employed to designate like parts throughout the same. Various items of equipment, such as fasteners, fittings, etc., in addition to various other elements and specific principles of their operation, are omitted to simplify the description. However, those skilled in the art will realize that such conventional equipment and principles of operation can be employed as desired.

Figure 1:
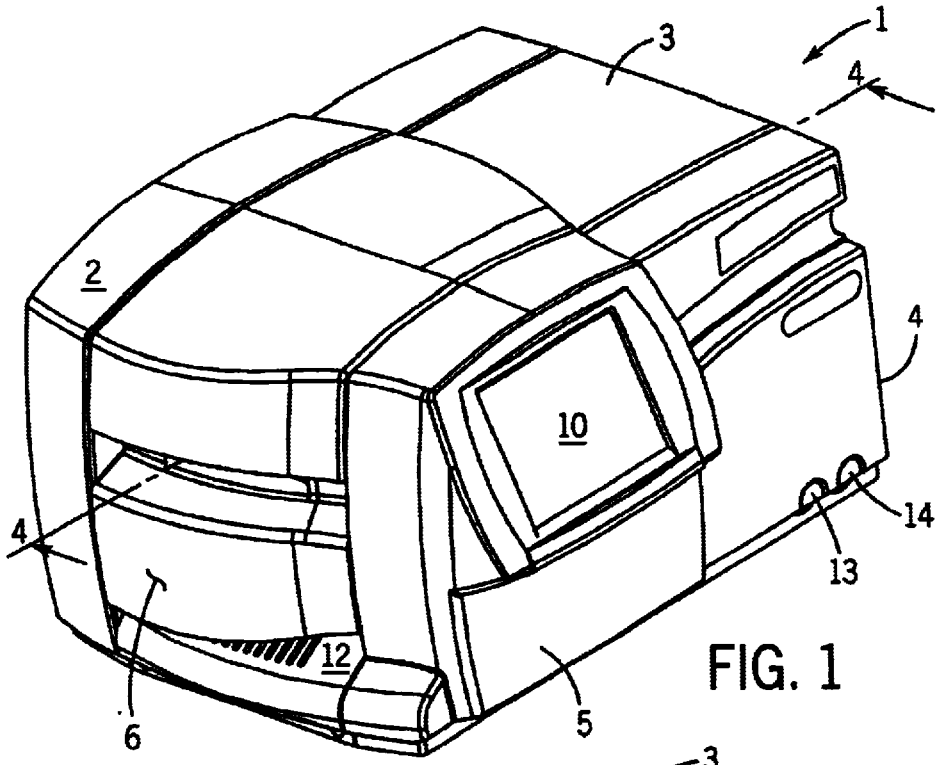
FIG. 1 is a perspective view of a label printer-cutter according to one aspect of the present invention.

Shown in FIG. 1 is label printer 1. In a preferred embodiment, printer 1 can accomplish both printing and cutting operations in a single unit and thus, label printer 1 can also be referred to herein as a "label printer-cutter". Printer 1 includes a plastic housing 2 having a front 4, a back (not shown), a left side 6 and a right side (not shown). Printer 1 includes cover portion 3 and base portion 5. In FIG. 1, the cover portion is closed, and so printer 1 is shown in a configuration that is suitable for, for example, operation or transport.

Housing 2 supports an LCD screen 10 that can be pivotally mounted to housing front 4. Printed labels (not shown) are ejected from printer 1 via exit chute 12 formed in the housing side 6. LCD screen 10 can display, among other things, printer status and error indicators to a user of the printer. First adjustment mechanism 13 can be included, for example, to control and/or adjust LCD screen 10 brightness. Other parameters, such as print or color intensity of an output label, can also be adjusted, for example, by second adjustment mechanism 14.

Although not shown, it is contemplated that the printer 1 can be connected to, and usable with, a data entry device, such as keyboard, for entering alpha-numeric information necessary for preparation and design of a desired output. Printer 1 can include firmware (e.g., software designed on a platform such as Windows CE™), available from Microsoft and software for controlling, in whole or in part, various printer assemblies, among them the registration assembly, described below.

As used in this application, to "register" means to align, so as to position in alignment, for example, one device, apparatus or assembly with respect to another and registration means to function, for example in a method of printing, so as to appropriately register.

Figure 2:
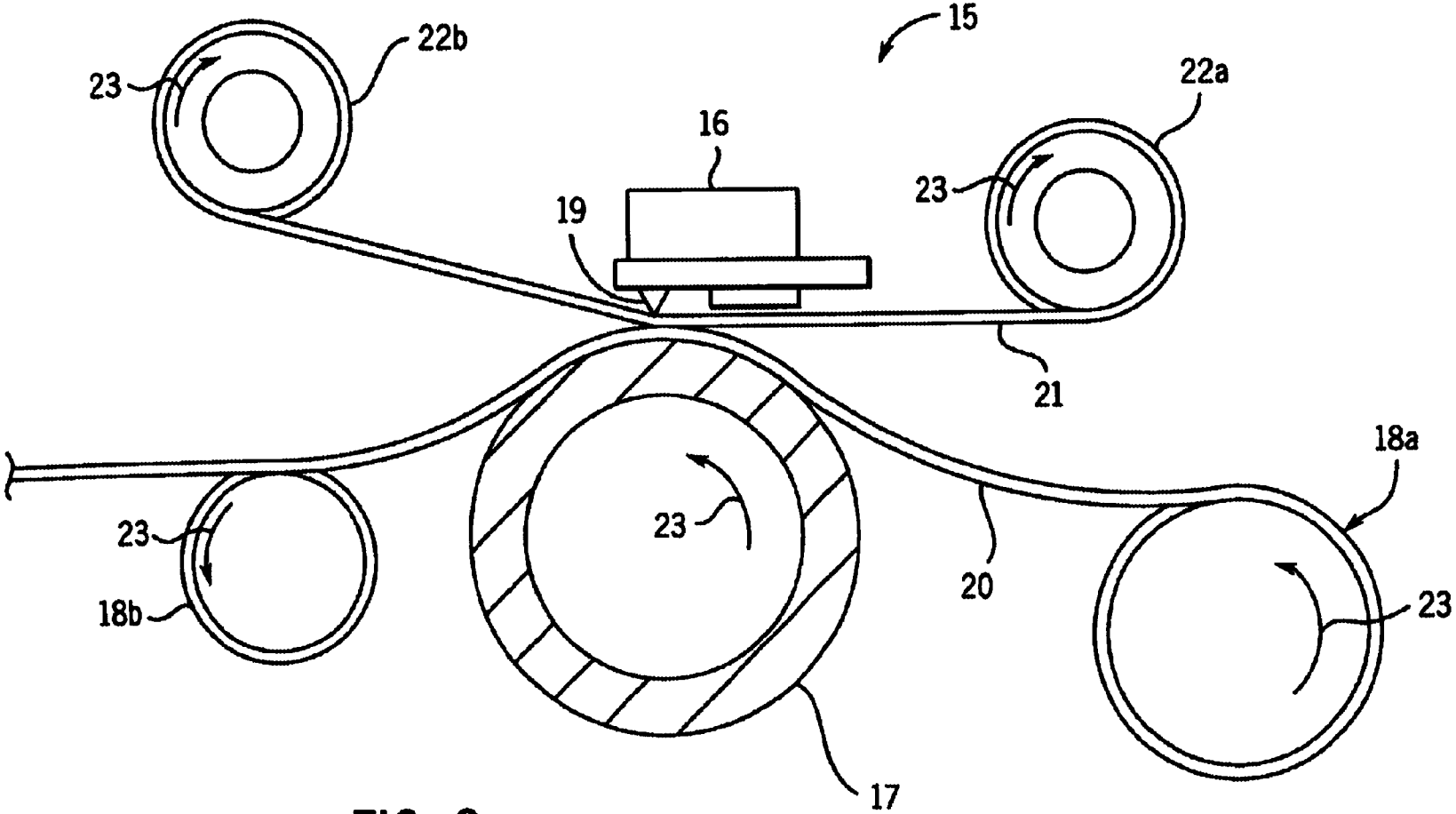
FIG. 2 is a schematic illustration of one embodiment of a printing arrangement that can be used with the label printer-cutter of FIG. 1.

A typical thermal printing arrangement 15 is illustrated schematically in FIG. 2 since, in a preferred embodiment, the label printer of FIG. 1 can be a thermal label printer. Printing arrangement 15 includes print head 16, support (platen) roller 17, label media delivery roller 18*a*, and label media take-up roller 18*b*. Label media delivery and take-up rollers 18*a,b* can be separate components, or alternatively, they can be housed within a unitary structure (e.g., a label media supply cartridge). Print head 16 is typically equipped with a linear array of thermal elements 19. The number of thermal elements 19 in the linear array can vary, with a characteristic print head 16 employing one thousand two hundred forty-eight (1,248) thermal elements 19. Thermal elements 19 produce heat in response to energy supplied to print head 16. A current is applied to thermal elements 19 to heat the thermal elements to a level sufficient to transfer dots onto label media 20. This occurs when a thermally-sensitive (e.g., an ink ribbon) supply 21 comes into thermal contact with thermal elements 19. Printing arrangement 15 includes thermally-sensitive supply delivery roller 22*a* and thermally-sensitive supply take-up roller 22*b*. Thermally-sensitive supply delivery and take-up rollers 22*a,b* can be separate components, or alternatively, they can be housed within a unitary structure (e.g., an ink ribbon cartridge). It is contemplated that color printing can be accomplished as well as black (along with shades of gray). Directional arrows 23 indicate the direction of travel of platen roller 17, label media delivery and take-up rollers 18*a,b* and thermally-sensitive supply delivery and take-up rollers 22*a,b* in printing arrangement 15. Other structures (e.g., a ceramic material layer) may be included in the printing arrangement between the print head and the label media to be printed. Thermal elements 19 transfer dots to label 20 in a line, called a "dot line".

Figure 3:
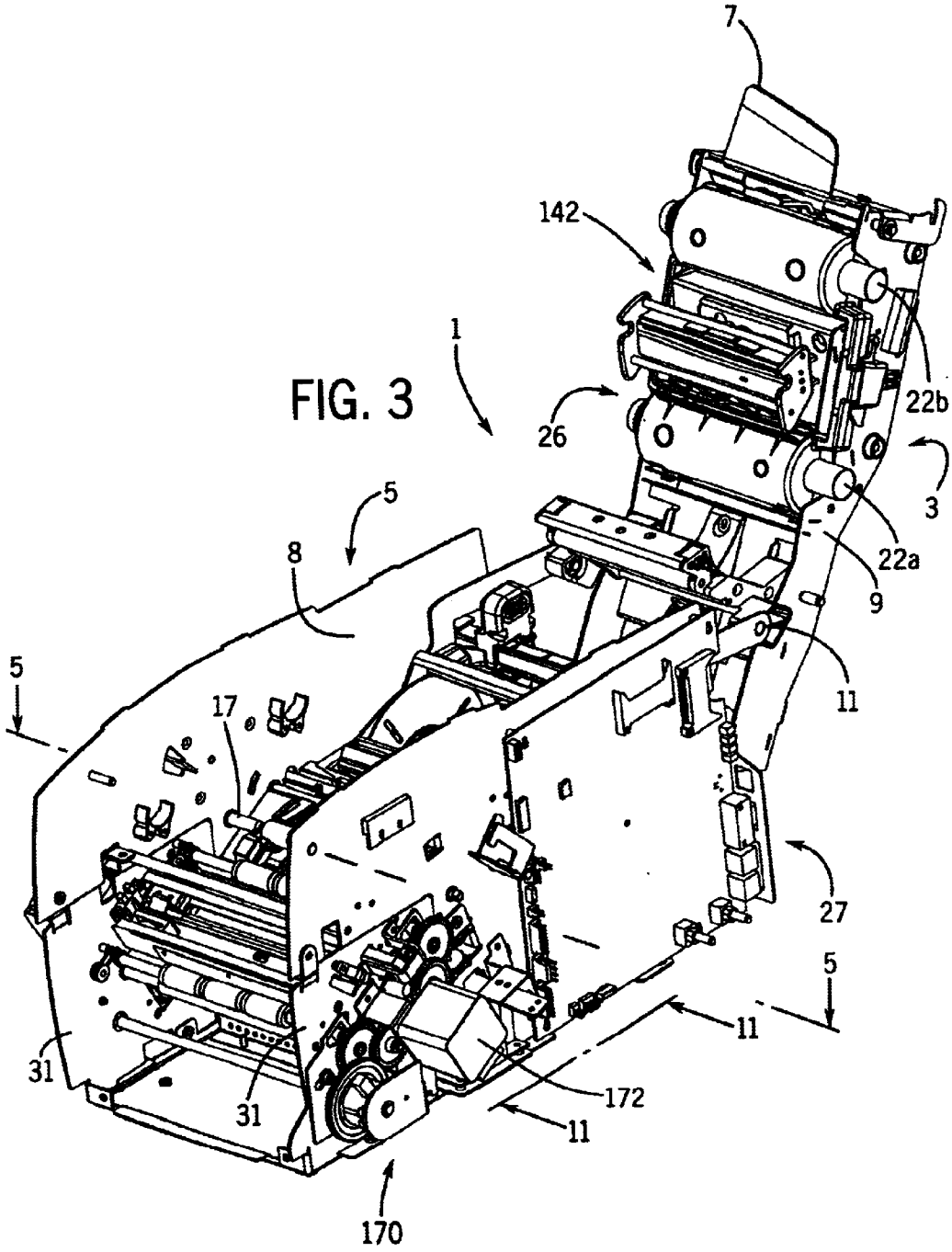
FIG. 3 is a side, perspective view of the label printer-cutter of FIG. 1 with a portion of the interior of the printer-cutter exposed.

Referring to FIG. 3, cover portion 3 having cover portion frame 9, can be raised or opened to access the interior of printer 1, for example, when the printer is in an idle state, or when a label media is loaded. Cover portion 3 can be raised by releasing temporary securing mechanism 7 of cover portion 3 and applying a lifting force to the mechanism. Application of the lifting force causes cover portion 3 to pivot about a hinged attachment 11 of printer 1. Label printer 1 also includes a base portion 5 having a base portion frame 8 (which itself can include a separate and removable subassembly frame portion 31). Cover portion 3 further includes a print head assembly 142 mounted to cover portion frame 9. Base portion 5 includes label media support or platen roller 17 attached to base portion frame 8. As shown, a ribbon cartridge 26, used for holding and supplying a thermally sensitive ribbon (not shown), can be insertably attached to cover portion frame 9. Ribbon cartridge 26, as depicted in FIG. 3, comprises ribbon delivery roller 22*a* and ribbon take-up roller 22*b*. Ribbon supply roller 22*a* and ribbon take-up roller 22*b* can include gears (not shown) disposed on an end of each roller. As ribbon supply roller 22*a* turns, the thermally-sensitive ink ribbon (not shown) is expelled and fed past print head assembly 142 and is wound upon ribbon take-up roller 22*b*. In applications in which color printing is desired, the ribbon can include or be divided into color panels or portions according to a known printing color scheme (e.g., cyan, magenta, yellow, and black) and the panels are fed past the print head to print one color at a time.

Referring generally to FIGS. 1–3, label printer assemblies (e.g., label printer print head assembly 142) and LCD screen 10 are controlled by printer circuitry. Housing 2 of label printer 1 can be manufactured, along with its various assemblies, according to known manufacturing principles (e.g., injection molding) and using known materials (e.g., plastic, metal, and the like). Frame portions 3 or 5 can be designed to hold programmable memory devices known as flash cards that can be used to store firmware and software routines. Flash cards are typically used during product development to facilitate updates to the firmware and other software. Flash cards can be replaced by permanently programmed memory chips. Using the above described firmware and software and the associated memory devices, printer assemblies such as a print head assembly 142 can be activated and controlled in an automated fashion. As shown, the flash cards or other memory can be installed at location 27. Generally shown in FIG. 3 is cutter roller cam drive assembly 170 (or simply referred to as "roller drive assembly"), which is described in detail with respect to FIG. 11 below.

Figure 4:
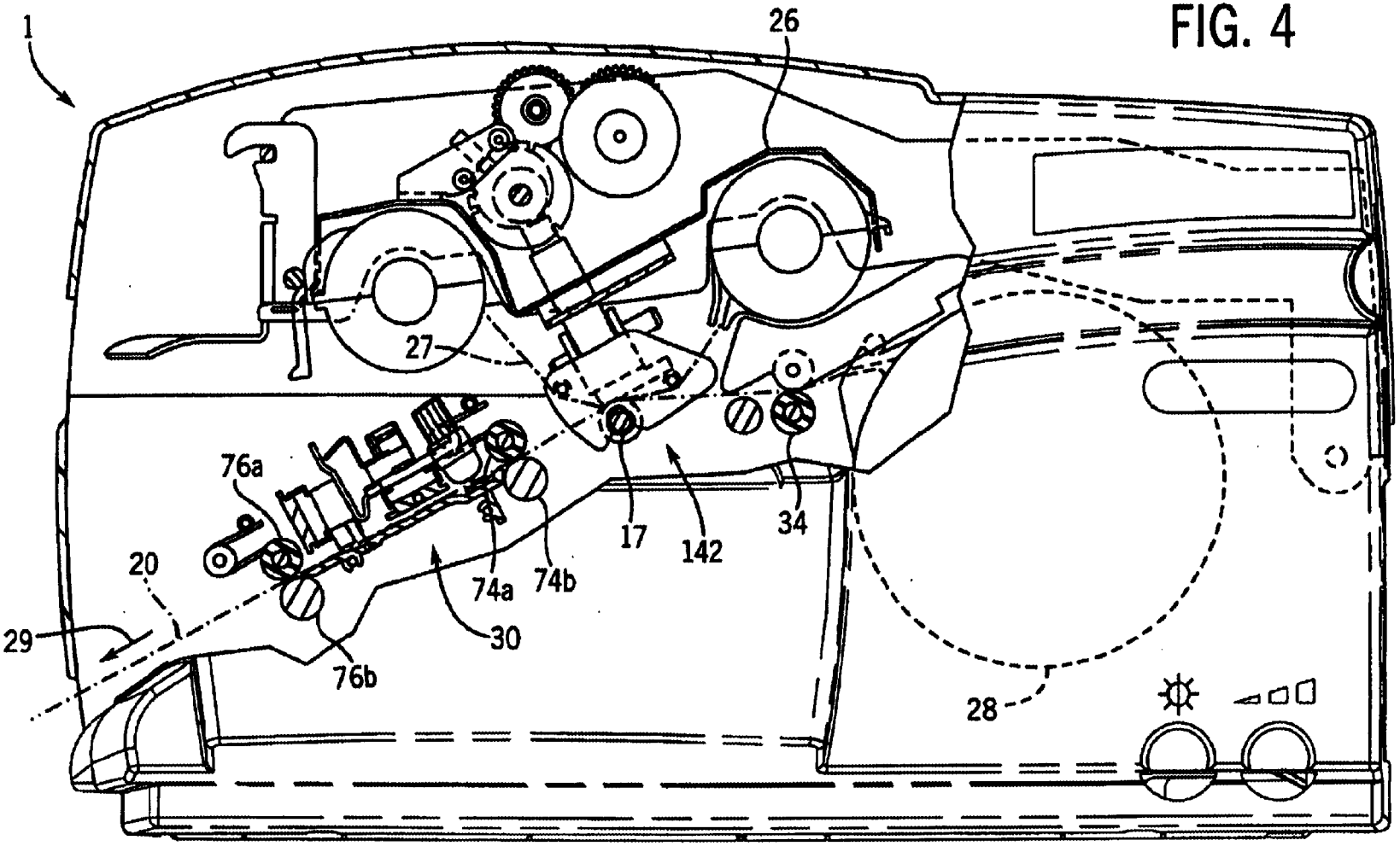
FIG. 4 shows an enlarged, partially schematic, cross-sectional view of the label printer-cutter taken along line 4—4 of FIG. 1, the label printer-cutter including a registration assembly and a cutting assembly according to one aspect of the present invention.

FIG. 4 shows a schematic illustration of label printer-cutter 1. Label media 20 is dispensed from label media supply cartridge 28 (shown in dashed lines) in a label media direction, indicated by arrow 29. Ink ribbon 27 is dispensed from ribbon cartridge 26. As shown, label media 20 and ink ribbon 27 pass in overlay fashion past print head assembly 142. Once printing has been completed, label media 20 can be fed to cutting assembly 30. Print head assembly 142 and cutting assembly 30 are detailed below. Encoder roller shaft 34 is also shown. Encoder traction roller 34 works in conjunction with an encoder to measure or meter the amount of label media that has passed a given point. Such metering facilitates accurate printing, particularly in multicolor printing applications. Cutter rollers 74*a,b* and 76*a,b* are also shown and are described in greater detail below.

Operation of the encoder roller with respect to the label media is more fully described in a co-pending U.S. patent application entitled "Encoder-based Control of Printhead Firing in a Label Printer", filed concurrently with the present application and which is fully incorporated by reference herein.

Figure 5:
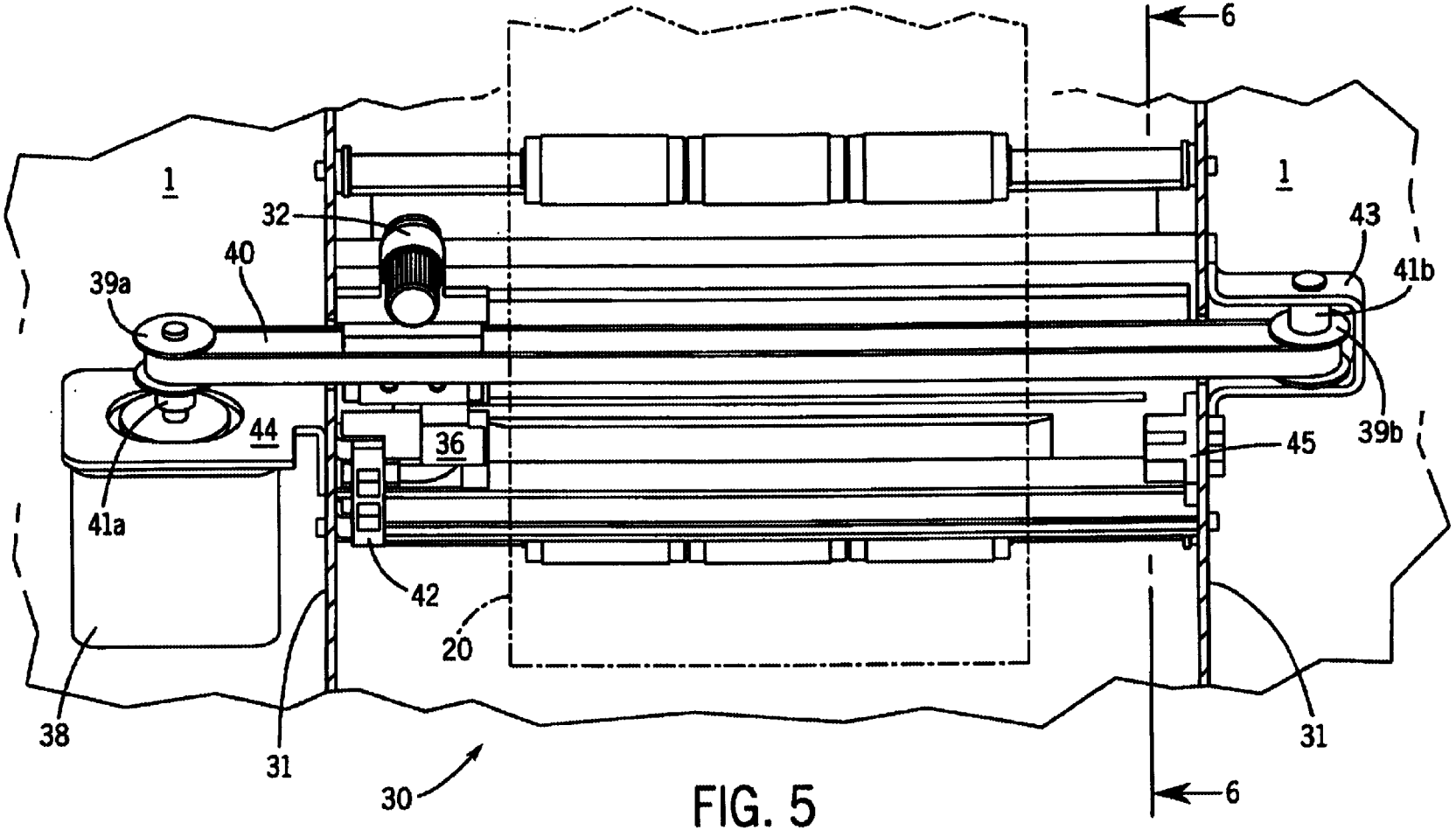
FIG. 5 is an elevational view taken along line 5—5 of FIG. 3 illustrating an embodiment of the cutting assembly according to one aspect of the present invention.

FIG. 5 shows an enlarged cross-sectional view taken along line 4—4 of FIG. 1 illustrating one embodiment of label printer cutting assembly 30 connected to cutting assembly or subassembly frame portion 31 of printer 1 according to one aspect of the present invention. Cutting assembly 30 includes a plotter cutter 32 to effect plotter cutting of label media 20 (shown in phantom) to form one or more discrete labels. The cutting assembly further includes end cutter 36 to effect end cutting (also called "shear cutting" or "cutting off") of a label media. Thus, cutting assembly 30 includes, in a preferred embodiment, separate or distinct plotter and end cutters. It will be recognized that end cutting can take place with or without plotter cutting of the label having first taken place. It will be further recognized that cutting assemblies that permit one or both types of cutting operations (i.e., end and/or plotter cutting operations), or other cutting operations, can be used in accordance with the present invention.

Cutting assembly 30 is generally driven using a drive mechanism, here shown as step motor 38. The manner in which cutting assembly 30 is driven is described in greater detail with reference to various figures below, but it is noted that belt 40 is a timing belt that is used generally to effect proper cutting of label media 20 via the cutting assembly. As shown, timing belt 40 is driven by step motor 38 via pulleys 39*a,b* that are connected to shafts 41*a,b,* respectively, with shaft 41*a* connected to step motor 38 and shaft 41*b* connected to bracket 43. Bracket 43 is connected to frame 31. Step motor 38 is also connected to frame 31 by bracket 44. As shown, in a preferred embodiment, end cutter home sensor 42 and plotter cutter home sensor 45 are included in the cutting assembly connected to frame 31. Sensor 42 is used to determine when end cutter 36 has reached, or is located at, a home or rest position. Similarly, sensor 45 is used to determine when plotter cutter 32 has reached, or is located at, a home or rest position. As a practical matter, the home or rest position for the end cutter (and similarly for the plotter cutter) can be reversed, or at any convenient location within frame 31, since the firmware and/or software associated with the label printer can accommodate such positional variation.

Figure 6:
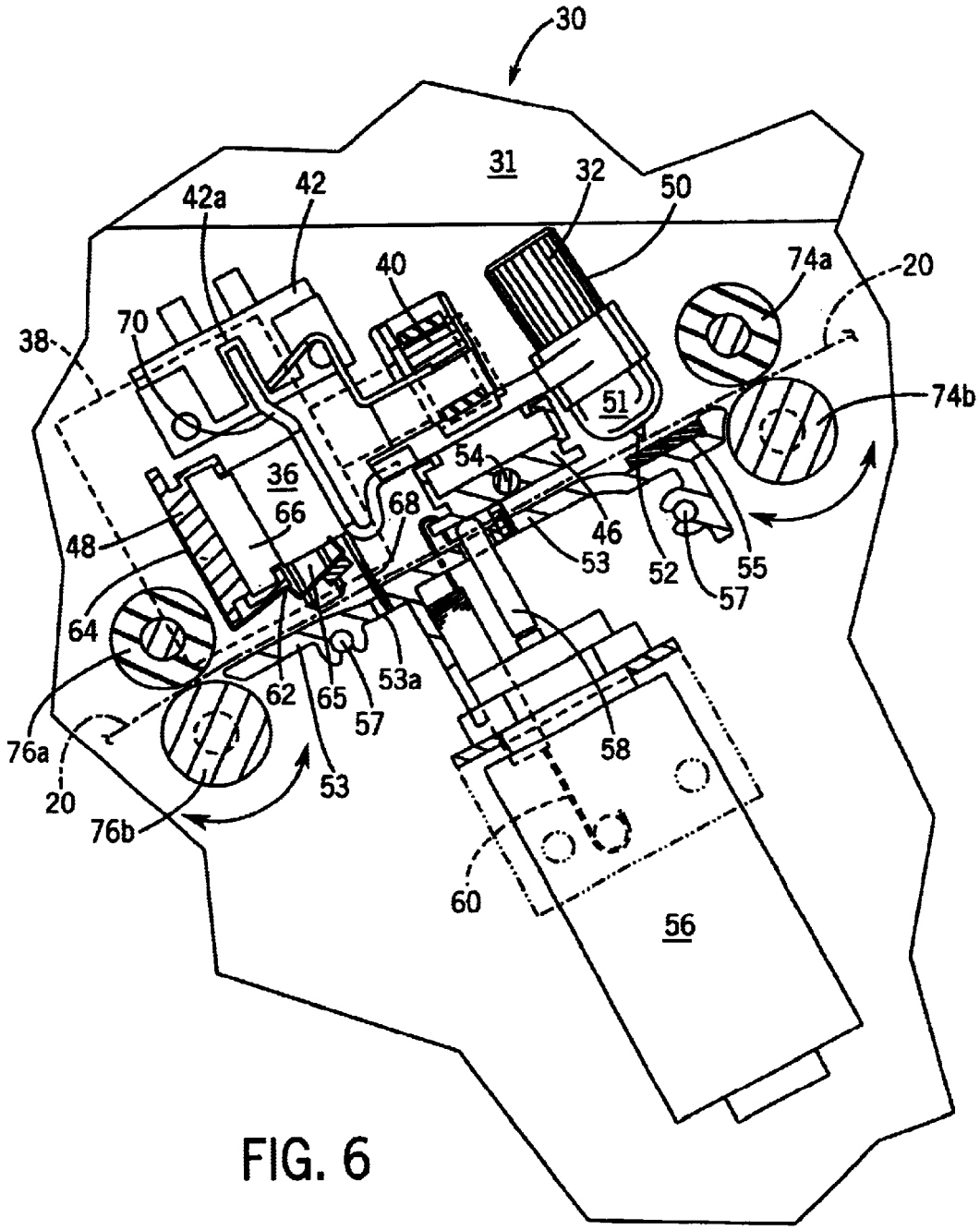
FIG. 6 is an enlarged cross-sectional view of the cutting assembly taken along line 6—6 of FIG. 5.

FIG. 6 shows an enlarged, detailed cross-sectional view taken along line 6—6 of FIG. 5. Cutting assembly 30 is shown and includes plotter cutter 32 and end cutter 36. Plotter cutter 32 comprises knob 50 and a plotter cutter pin blade 52. Knob 50 is used to adjust plotter cutter cutting depth, such as an initial cutting depth of plotter cutter cutting pin blade 52. The initial blade cutting depth (i.e., blade protrusion) may be measured and set to a specific value at the time of label printer manufacture. Knob 50 adjusts cutting depth via connecting section or nose 51, and the depth is adjusted with respect to label media 20. Label media 20 rides on label support 53, which is connected to frame 31 of the label printer, here via connections 57. Label cutting pad 55 can be included below pin blade 52 between label media 20 and label support 53. Cutting pad 55 protects pin blade 52 so as to increase pin blade cutting life. Cutting pad 55 is typically made from materials such as nylon or Delrin™ (a polyoxymethylene-type acetal resin).

Still referring to FIG. 6, plotter cutter 32 engages and slides along plotter cutter slide rail 46 and end cutter 36 engages and slides along end cutter slide rail 48. End cutter 36 comprises clamp 64 and clamp wheel 65 to permit the end cutter to slideably engage end cutter slide rail 48 via extension 66. End cutter slide rail 48 is fixedly mounted to cutter assembly frame 31. End cutter 36 further comprises cutter blade 68 to accomplish cutting off or shear cutting of label media 20. Plotter cutter slide rail 46 is pivotally mounted to cutter assembly frame 31 via pivot 54 (e.g., a pin, screw or other rotation-permitting connector). A solenoid 56, or other force-generating mechanism (e.g., a motor and lever mechanism), is connected to plotter cutter slide rail 46 via a connection or armature 58. Rollers 74*a,b* and 76*a,b* rotate and serve to position label media 20 in cutting assembly 30 for cutting. Rollers 74*a* and 76*a* rotate in the same direction (i.e., clockwise or counterclockwise) and rollers 74*b* and 76*b* will both correspondingly rotate in an opposite direction to rollers 74*a* and 76*a*. End cutter home sensor 42 senses when end cutter extension or flag 70 activates (e.g., using an optical technology) the sensor via end cutter home sensor slot 42*a*. Belt 40 moves plotter cutter 32 and end cutter 36 to effect proper cutting of label media 20 in cutting assembly 30.

FIG. 6 also illustrates that end cutter blade 68 rides within label support 53 channel 53*a* to effect end-cutting of a label media. It is understood, however, that other connection arrangements are possible and are known to those of skill for effecting cutting. Generally, solenoid 56 forces armature 58 upwardly. The solenoid force overcomes the tensile force of spring 60 (thereby extending the spring) in tension so as to rotate or tilt plotter cutter slide rail 46 about pivot 54. Plotter cutter 32 is thus placed in a plotter cutting position to cut label media 20 with the position located over cutting pad 55.

Operation of the cutting assembly is more fully described in co-pending U.S. patent applications entitled "Label Media-Specific Plotter Cutter Depth Control" and "Label Printer End and Plotter Cutting Assembly", both filed concurrently with the present application and both of which are fully incorporated by reference herein.

Figure 7:
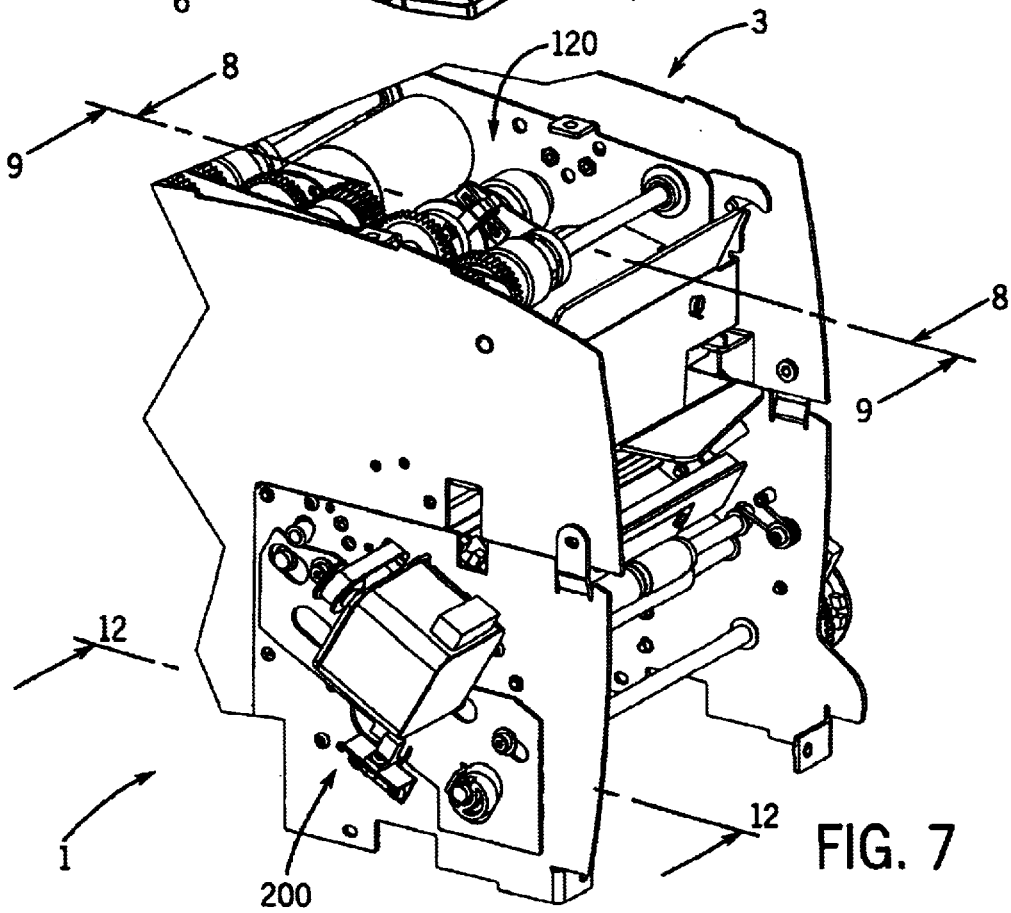
FIG. 7 shows a perspective view of a portion of the label printer-cutter from an opposite side of that shown in FIG. 3.

FIG. 7 shows a perspective view of a portion of label printer-cutter 1 having printing and cutting functionalities with the cover portion 3 of the printer-cutter in a closed position. As part of the printer-cutter printing capabilities, print head gear train 120 actuates movement of print head assembly 142 (FIG. 3), via, for example, one or more step motors (not shown). As part of the printer-cutter cutting capabilities, roller positioning assembly 200 actuates and appropriately positions cutting assembly rollers 74*a,b* and 76*a,b* (FIG. 6), via drive or motor 172 (FIG. 3). Roller positioning assembly 200, as detailed below with respect to FIGS. 11–17, ensures that printing and cutting operations do not take place within the printer-cutter simultaneously, or substantially simultaneously.

Figure 8:
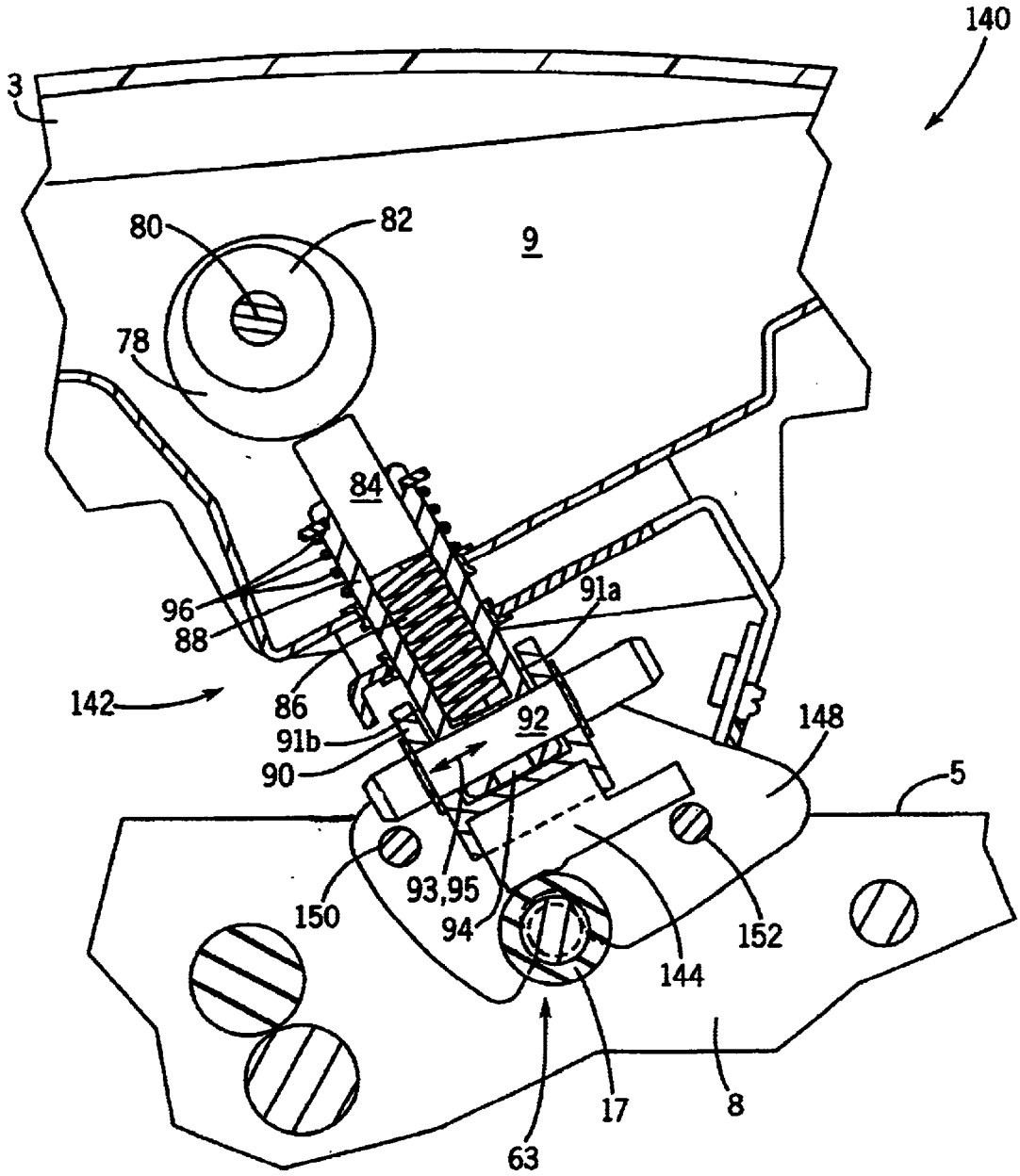
FIG. 8 shows an enlarged, cross-sectional, partially schematic view of a registration assembly taken along line 8—8 of FIG. 7 according to one aspect of the present invention.

FIG. 8 shows an enlarged cross-sectional view of label printer registration assembly 140. Registration assembly 140 includes print head assembly 142, which is mounted to cover portion frame 9 of cover portion 3. Registration assembly 140 further includes platen roller 17, which is secured to base portion frame 8 of base portion 5. Print head assembly 142 includes a print head lift cam 78 (also called an "offset cylinder") attached to cover portion frame 9. Lift cam 78 is secured to shaft 80 using fasteners, such as bushing 82. A driving mechanism, for example a step motor (not shown), can be used to drive movement of shaft 80, which in turn rotates cam 78. Cam 78 rotatably contacts rod or follower 84, and the rod contacts, so as to alternatively compress, or permit extension of, print head load spring 86. Cam 78 is in operable association with spring 86, which is housed by print head assembly pin 88. Pin 88 is connected to print head 144 via print head mount 90. Registration face 148 is shown connected to print head assembly 142 by print head mount 90 and ribbon guide bars 150 and 152. Platen roller 17 is shown secured to base portion frame 8. Platen roller 17 and registration face 148 are shown to be engaged, or in registration. Retraction spring 96, connected to print head mount assembly pin 88 is included to facilitate retraction upwardly of print head assembly 142. Print head pivot pin 92 passes through, so as to pivotally connect, print head mount assembly pin 88 and print head mount 90. A movement-permitting clearance or space 94 also exists between mount 90 and print head 144. Clearances 91*a* and 91*b* permit movement of print head assembly 142 in directions corresponding to arrows 93, 95 to ensure that notches 61, 63 properly align with platen roller 17.

Figure 9:
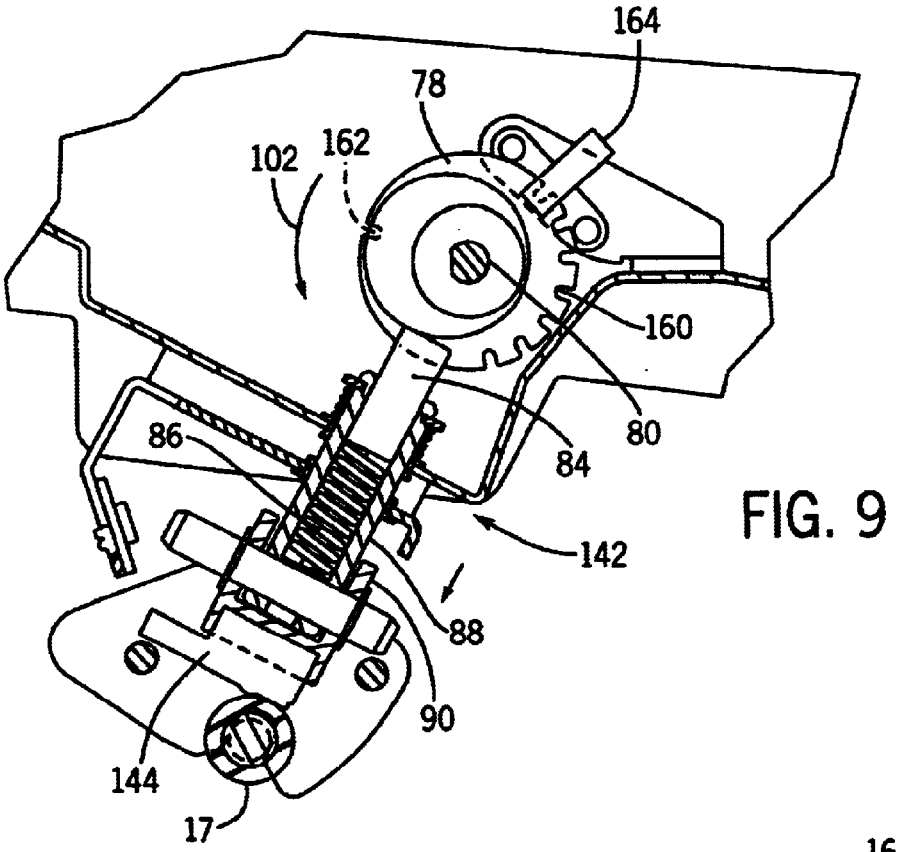
FIG. 9 shows a cross-sectional view of the registration assembly taken along line 9—9 of FIG. 7 according to one aspect of the present invention.
Figure 10:
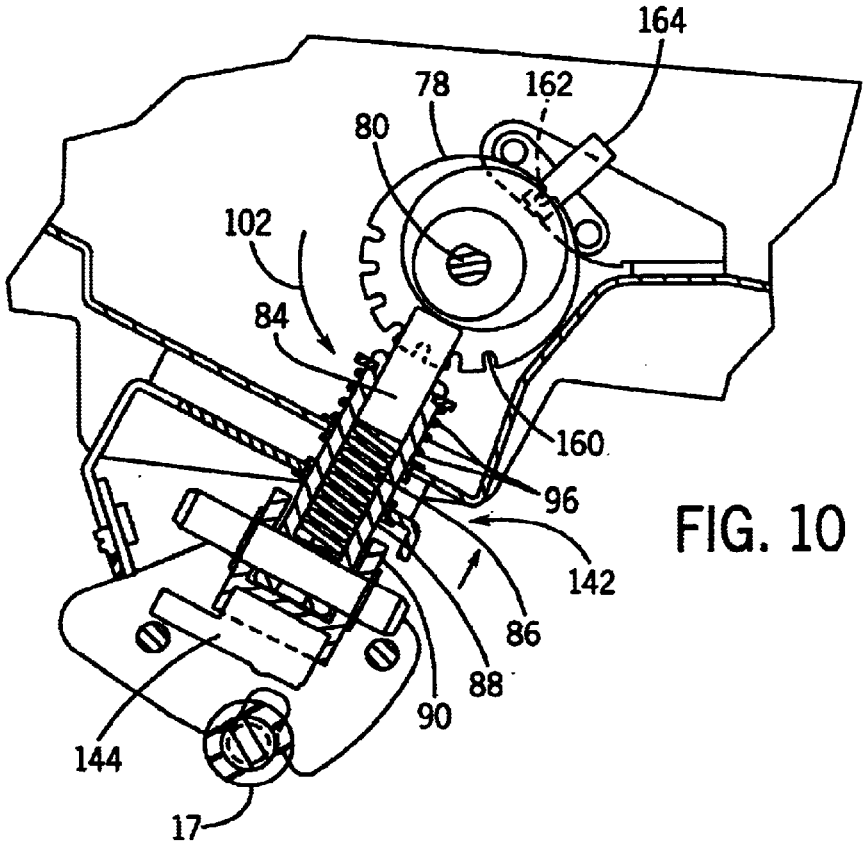
FIG. 10 shows a cross-sectional view of the registration assembly similar to that of FIG. 9 according to one aspect of the present invention.

Referring to FIGS. 9 and 10, in order to actuate movement of print head assembly 142, cam 78 rotates or turns, for example, in a direction corresponding to arrow 102. Rotation is imparted via shaft 80. Cam 78, as it rotates, contacts and drives cam follower or plunger 84 downwardly, so as to compress primary print head load spring 86, which is housed by print head assembly pin 88. Spring 86 connects at its bottom to print head mount 90, which is connected to print head 144. In this manner, load (also referred to as pressure or force) is transferred to print head 144. The print head is typically loaded for and during printing to the label media, as shown in FIG. 9. The print head generally remains loaded whenever the label media is advanced or retracted in label printer.

During ink ribbon advancement (e.g., when one color of a traditional color scheme such as cyan, magenta, yellow, and black has been printed and the next color is to be printed), it is desirable for printing not to occur, and yet maintain registration between the print head and the platen roller. To accomplish this result, the print head is preferably unloaded so that no load, or substantially no load, is transferred to the label media, thereby achieving unloaded registration. The print head 144 is shown in an unloaded position in FIG. 10.

As illustrated in FIG. 10, cam 78 is again rotated as before, for example, in a direction corresponding to arrow 102. Now, rotation of cam 78 causes follower to move upwardly, which permits primary print head load spring 86 to extend since the load imparted on spring 86 has been released. With the load removed, return or retraction spring 96 functions to raise print head assembly 142, and thus print head 144, upwardly so that there is a clearance or space between print head 144 and platen roller 17. In this manner, when the print head is unloaded, ink ribbon can be advanced as desired while the label media remains stationary. The print head can be unloaded in other instances, for example, when performing associated cutting operations to the label media (e.g., in a cutting assembly also located in the label printer), or when changing ink ribbon cartridges. In general, the print head is typically unloaded when printing to label media is not taking place (e.g., when the ink ribbon is advanced from one color to the next color in a multi-color print job).

Thus, in order to accomplish thermal printing, in addition to applying heat to the thermally-sensitive ribbon, it is also necessary to apply a load (also called a pressure or force herein) against the ribbon. A force is applied to the ribbon via the print head, and specifically the thermal elements, for example thermal elements 19 of FIG. 2. Therefore, physical contact must exist between the print head and the label media, in combination with the ink ribbon and the heated thermal elements, to effect printing. Because of variations in the media supply used (e.g., material type, thickness, and the like), each media will require a unique force in order to accomplish the requisite physical contact for printing to occur. Typical label media materials include polyester film, vinyl film, and polypropylene film, among others, and typical forces associated with these media range from about 10 to about 17 pounds force.

Accordingly, in a preferred embodiment, the load that is applied or transferred to the label media via the print head can be varied to accommodate, for example, the appropriate load for the specific label media used (i.e., a media-specific load). Thus, the print head can be called a "variably loaded" print head, or can be considered to be "variably loadable". It shall be understood that the terms "variably loaded" and "variably loadable" have been used to describe the print head for convenience only, as the terms can also be used to modify or otherwise describe, for example, the print head assembly, or other printer components associated with the print head. Moreover, it shall be understood that the load applied by the print head can be varied according to other parameters, such as, for example, the specific ribbon type or ink type that is utilized. In short, the terms "variably loaded" and "variably loadable" are to be interpreted to include varying the print head load applied during label printing according to any number of label-printing related parameters.

As noted above, the print head can be variably loaded to accommodate the desired media-specific loads. Media-specific loads can be determined in a variety of ways, but are often determined in a fashion that can be characterized as iterative or intensive trial and error. In a preferred embodiment, specific loads are determined for a variety of desired label media using empirical testing techniques. These loads, or values representative of the loads, can then be stored in a memory (e.g., a chip, smart cell, etc.) that can be attached, or located proximate, to a label media, for example, on label media supply cartridge, such as the one shown in FIG. 3. A label printer microprocessor can read the label media supply-specific load values from the memory, for example, when the label media cartridge having the memory device attached thereto is inserted into the label printer.

In a preferred embodiment, the label printer registration assembly comprises a thermal print head of the kind described above, namely, a print head that produces printed dots one line at a time (according to a desired sequence of print head elements that are fired). The registration assembly operates to ensure that each dot line is appropriately printed. Thus, in a preferred embodiment, the label printer registration assembly is referred to as a "label printer dot line registration assembly".

Platen roller 17 is generally termed herein a "registration roller". Because other arrangements are possible, and other rollers may serve to accomplish registration, it is understood that other rollers (e.g., passive or pinch, as well as active or driven rollers) can constitute registration rollers. As shown in FIGS. 9 and 10, position slots or notches 160 corresponding to the desired, media-specific load(s) can be included on, or otherwise formed in, the print head lift cam mechanism. With the load value(s) having been read by the printer microprocessor, appropriate printer circuitry can be used to drive the print head cam to the appropriate cam position slot. As a result, the print head is loaded according to the supply-specific load. Position slot 162, as shown, corresponds to an unloaded position. In a preferred embodiment, values associated with various cam position slots are programmable, for instance, in printer memory, such that each position slot always corresponds to the same value. In a preferred embodiment, cam sensor 164 can be used to determine which cam position slot has been engaged and communicate this information with the printer microcontroller.

In general, the label media and ink ribbon pass in overlay relationship with each other. The platen roller serves to the register print head, and more particularly, the thermal elements of the print head, with respect to the label media and ink ribbon. This ensures that the dot line that is ultimately printed to a label media, which is supported by the platen roller, is printed at a desired location (i.e., proper spacing between printed lines, margins, and the like).

Operation of the registration assembly is more fully described in a co-pending U.S. patent application entitled "Label Printer Dot line Registration Assembly", filed concurrently with the present application and which is fully incorporated by reference herein.

Figure 11:
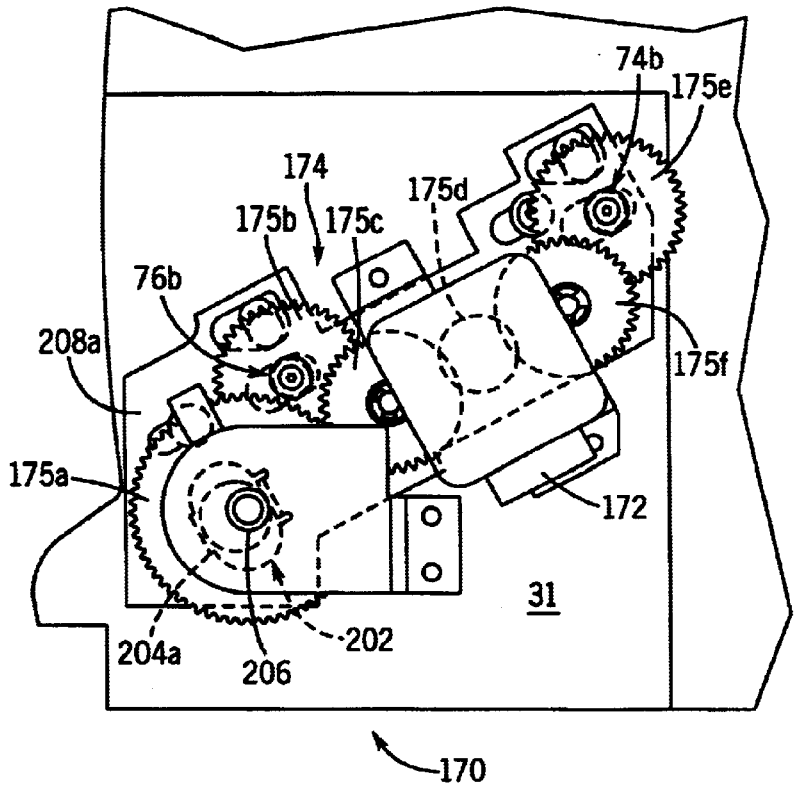
FIG. 11 is an enlarged, planar view taken along line 11—11 of FIG. 3 showing a roller drive assembly according to one aspect of the present invention.

Referring to FIG. 11, roller drive assembly 170 is shown. Assembly 170 includes motor 172, for example a step motor, and is connected, so as to move, a drive train, generally referred to by numeral 174. Drive train 174, as shown, includes a plurality of gears 175*a–f* and is connected to cutting assembly frame 31 so as to permit rotation of the gears. Roller drive assembly 170 generally functions to rotate cutting assembly drive rollers 74*b* and 76*b* as well cams 204*a,b* (cam 204*b* shown in FIG. 12) of cam assembly 202, which itself rotates on a cam shaft 206 to move first cross slide plate 208*a* and second cross slide plate 208*b* (shown in FIG. 12), both of which are slideably engaged, as described below, to cutting assembly frame 31. An electric clutch (not shown) can be used to move drive train 174 so as to impart selective motion (e.g., a unidirectional rotational motion) to cam 202 as required.

Figure 12:
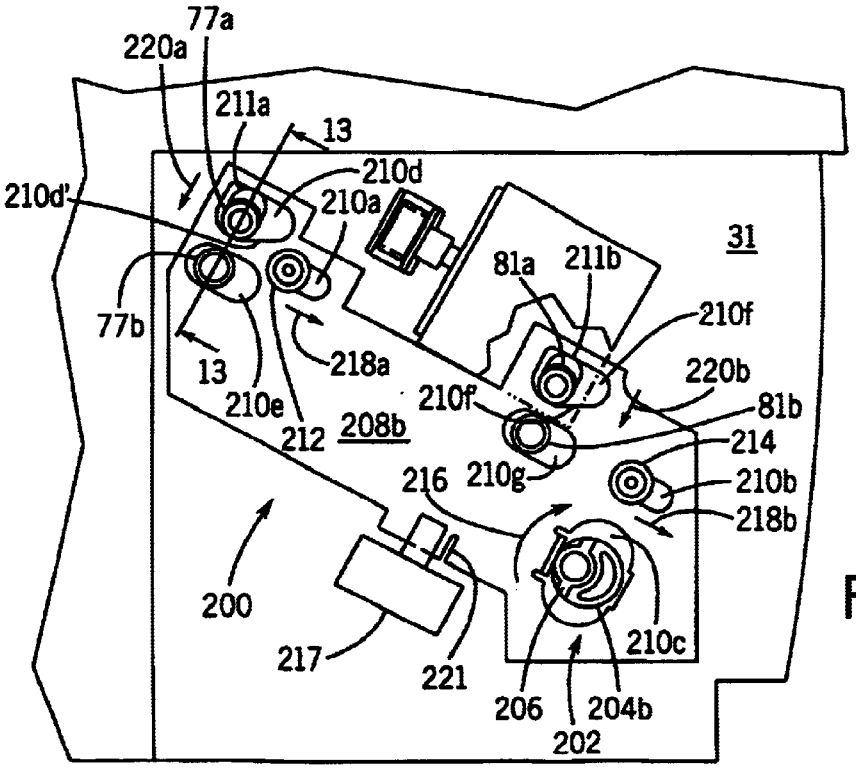
FIG. 12 shows a cross-sectional view of a roller positioning assembly taken along line 12—12 of FIG. 7.
Figure 13:
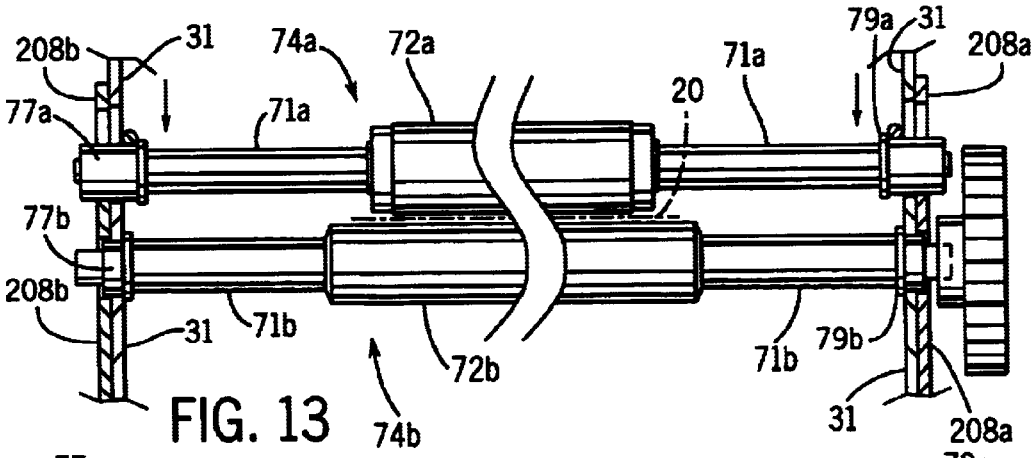
FIG. 13 is a cross-sectional view taken along line 13—13 of FIG. 12.

In FIG. 12, a roller positioning assembly, generally referred to as numeral 200, connected to cutting assembly frame 31. Roller positioning assembly 200 is shown in a cutting position, namely, a position that corresponds to label cutting (e.g., end and/or plotter cutting) in the label printer-cutter. FIG. 13 shows a view taken along line 13—13 of FIG. 12 illustrating in detailed fashion positioning of rollers 74*a,b* according to one aspect of the present invention.

Referring to FIGS. 12 and/or 13, in order for a cutting operation to take place, the distance between rollers 74*a,b* and specifically, widened roller portions 72*a,b* is decreased to a distance corresponding approximately to the width of the label media 20. In this fashion, rollers 74*a,b* can contact, and effect movement of, label media 20 via their rotation. As shown, rollers 74*a,b* are connected to cutting assembly frame 31 in a conventional manner using bushings 77*a,b* and 79*a,b*. Again, roller positioning assembly 200 includes first and second cross slide plates 208*a,b*. Cross slide plate 208*b* includes a plurality of slots 210*a–g*. Retainers 212 and 214 engage slots 210*a* and 210*b* to permit cross slide plate 208*b* to slideably engage with cutting assembly frame 31. Cam 204*b* of cam assembly 202 turns within slot 210*c*. Roller pair bushings 77*a,b* and 81*a,b* engage cross slide plate 208*b* via slots 210*d–g* in the cross slide plate and slots 211*a,b* in cutting assembly frame 31. Cross slide plate slots 210*d,f* include angled or sloped sections 210*d'* and 210*f'*. Rotation of cam assembly 202, as indicated by arrow 216, causes cross slide plate to slide, as indicated by arrows 218*a,b* causing bushings 77*a* and 81*a* to ride along sloped portions

210*d*' and 210*f*", thereby decreasing the distance between the bushings in a direction corresponding to arrows 220*a,b*. Cross slide plate 208*a* includes similar positional slots to those of plate 208*b* described above.

Thus, as shown in FIGS. 12 and 13, using coordinated movement of cross slide plates 208*a* and 208*b*, the distance between bushings 77*a,b*, has been decreased. Since rollers 74*a,b* are connected along their shafts 71*a,b* to their respective bushings, the distance between rollers 74*a,b* is accordingly decreased. In a similar fashion, the distance between bushings 81*a,b* can be decreased so that the distance between rollers 76*a,b* (not shown), can be decreased. Cutting assembly rollers 74*a,b* are thus shown to be properly positioned to move label media 20 during cutting of label media.

Figure 15:
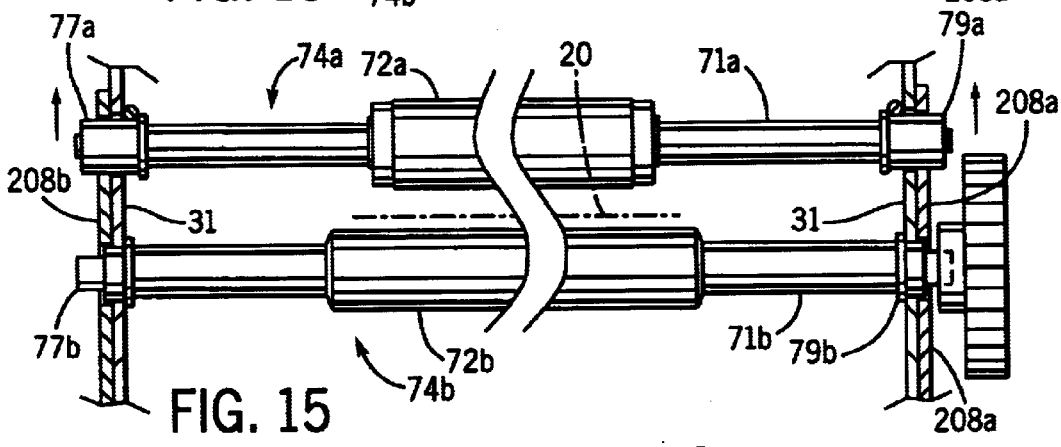
FIG. 15 is a cross-sectional view taken along line 15—15 of FIG. 14.
Figure 14:
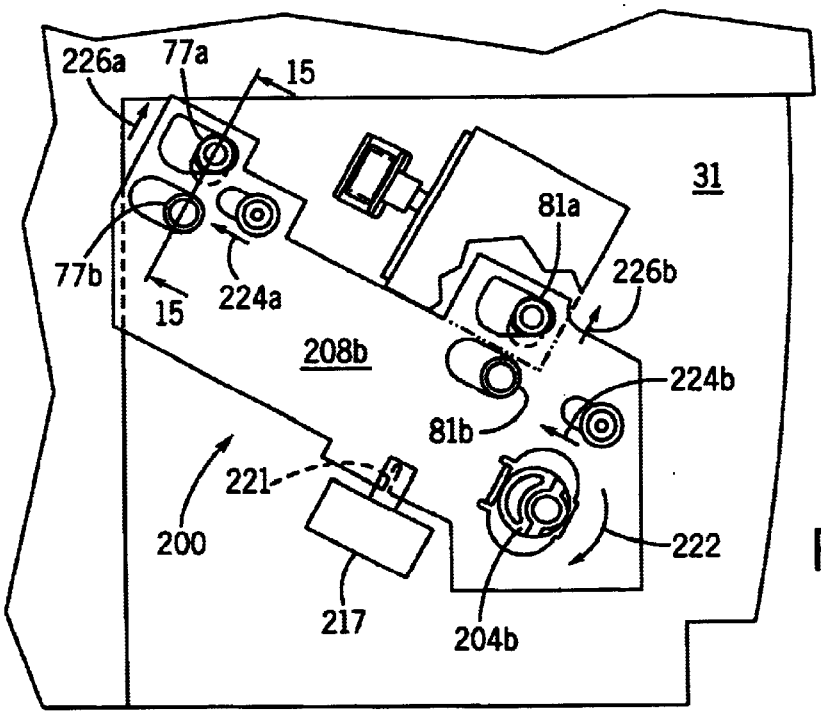
FIG. 14 shows a cross-sectional view of a roller positioning assembly similar to that of FIG. 12.

In FIG. 14, roller positioning assembly 200, connected to cutting assembly frame 31, is again shown. Roller positioning assembly 200 is shown in a non-cutting position, namely, a position that corresponds to printing taking place in the label printer-cutter. FIG. 15 shows a view taken along line 15—15 of FIG. 14 illustrating in detailed fashion positioning of rollers 74*a,b*.

Referring to FIGS. 14 and/or 15, in order for roller positioning assembly to move rollers 74*a,b* into a non-cutting position, the distance between rollers 74*a,b* and specifically, widened roller portions 72*a,b* is increased so that label media 20 is not driven or moved due to rotation of cutting assembly roller 74*b*. The motion of the roller positioning assembly, and in particular cross slide plates 208*a,b* is directly opposite to that described above with respect to FIGS. 12 and 13, as indicated cam rotational arrow 222, and cross slide plate arrows 224*a,b* and cutting assembly roller arrows 226*a,b*.

Thus, as shown in FIGS. 14 and 15, using coordinated movement of cross slide plates 208*a* and 208*b*, the distance between bushings 77*a,b*, has been increased. Since rollers 74*a,b* are connected along their shafts 71*a,b* to their respective bushings, the distance between rollers 74*a,b* is accordingly increased. In a similar fashion, the distance between bushings 81*a,b* can be increased so that the distance between rollers 76*a,b* (not shown), can be increased. Cutting assembly rollers 74*a,b* are thus shown to be properly positioned so as not to move label media 20 during printing to the label media.

Referring to FIGS. 11–15, sensor 217 (e.g., an optical sensor) can be used to determine the position of one or more of the cutting assembly rollers. Cam 204*b* drives cross slide plate 208*b* upwardly and to the left as indicated by arrows 224*a* and 224*b*. To achieve a desired roller position, for example the roller position shown in FIGS. 12–13, stepper motor travels a preset number of steps. When cam 204*b* has traveled a maximum amount, slot 221 triggers sensor 217 and stops rotation of cam assembly 202. Roller positioning assembly 200 can be reset using sensor 217 after coordinated movement of rollers from, for example, the roller position illustrated in FIGS. 12–13 to that of FIGS. 14–15.

Figure 16:
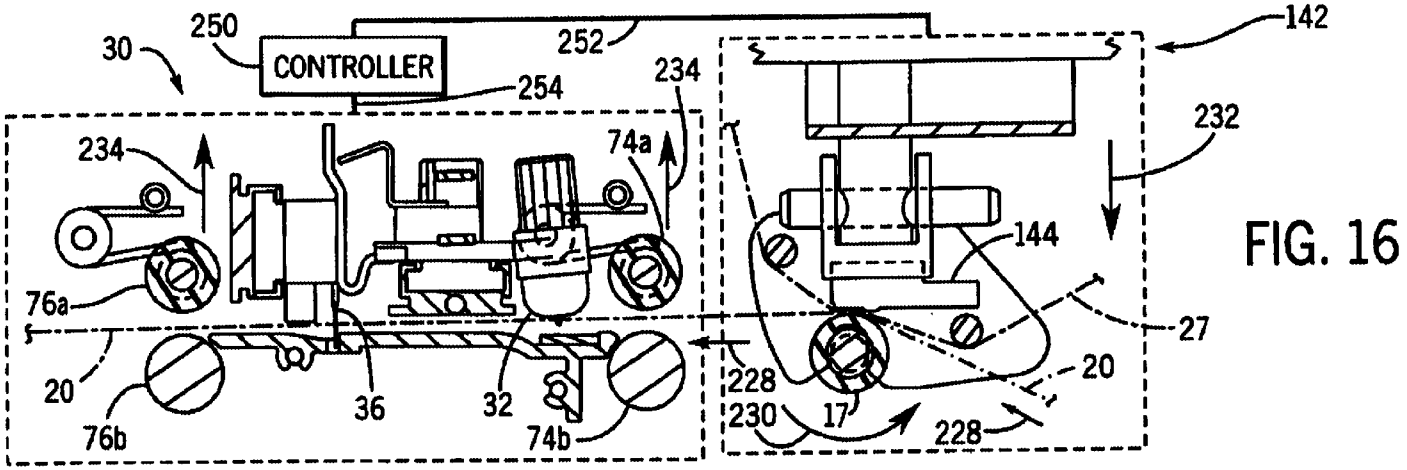
FIGS. 16–17 are schematic illustrations of mutually-exclusive printing and cutting operations according to one aspect of the present invention.
Figure 17:
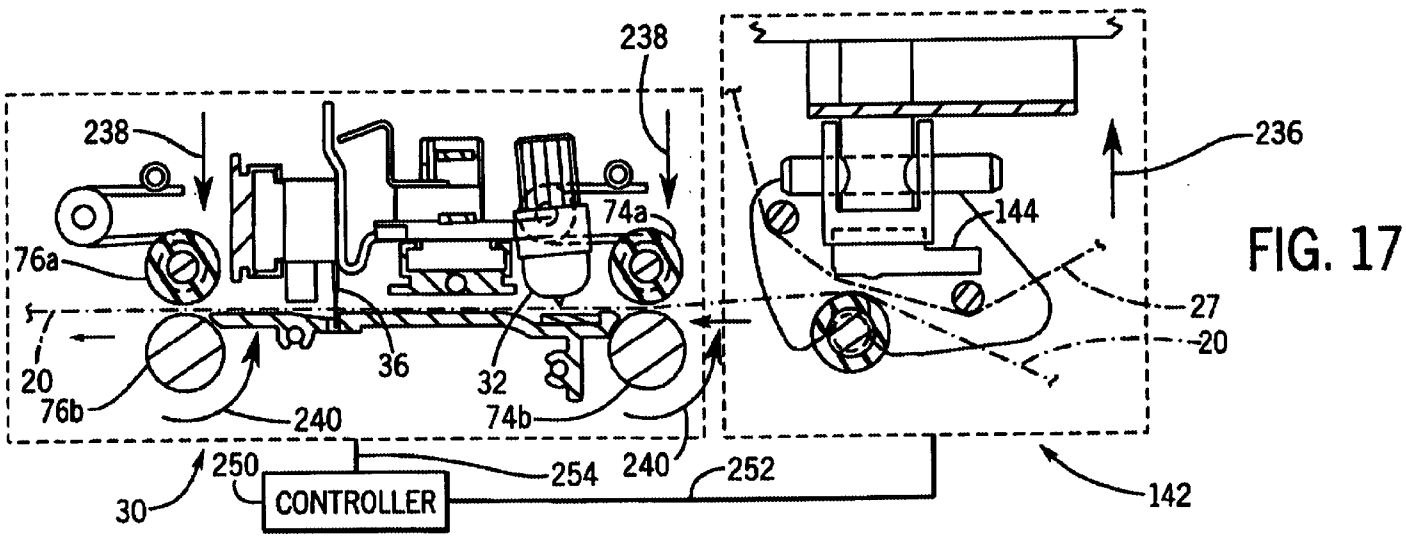

FIGS. 16–17 are schematic illustrations of mutually exclusive printing and cutting operations in the label printer-cutter. By "mutually exclusive printing and cutting operations" it is meant that printing to and cutting of a label media in the label printer cutter does not take place simultaneously or substantially simultaneously. In a preferred embodiment, printing and cutting cannot take place simultaneously or substantially simultaneously since printing must be completed (and the print head moved away from the label media) before cutting can begin. Similarly, during repeated printing and cutting, or from one label-making run to another, cutting must be completed before printing can once again be instituted.

In FIG. 16, print head assembly 142 and cutting assembly 30 are shown during printing to a label media 20. Ink ribbon 27 (preferably color ink ribbon for use in color printing) is fed around past print head 144 and label media 20 advances in a label media direction, indicated by arrows 228, by rotating platen roller 17, the rotation of the platen roller indicated by arrow 230. Ink ribbon 27 and label media 20 thus pass print head 144 in an overlay relationship to effect printing to the label media. Print head assembly 142 has been lowered, indicated by arrow 232, to achieve load registration between print head 144 and platen roller 17.

Cutting assembly rollers 74*a,b* and 76*a,b* are shown, and more specifically, upper rollers 74*a* and 76*a* are shown in a non-cutting position with respect to label media 20. The positioning of cutting assembly rollers 74*a,b* and 76*a,b* is generally indicated by arrow 234 Plotter cutter 32 and end cutter 36 are situated in a home or rest position such that they do not impede label media 20 during printing.

Controller 250 (e.g., a microprocessor) is in operative association, indicated by connections 252 and 254, with print head assembly 142 and cutting assembly 30 so as to provide independent operation of each. More specifically, controller 250 is responsible for positioning cutting assembly rollers in the non-cutting position as shown, and then positioning print head 144 for printing to the label media. It shall be understood that one or more controllers can be used to effect such mutually-exclusive printing and cutting operations in the label printer-cutter.

FIG. 17, illustrates print head assembly 142 and cutting assembly 30 during cutting (e.g., end cutting, plotter cutting, etc.) of label media 20. Here, print head 144 has been raised, indicated by arrow 236, off of or unloaded from label media 20. Cutting assembly rollers 74*a,b* and 76*a,b* are shown. More specifically, upper rollers 74*a* and 76*a* are shown in a cutting position, having been lowered, as indicated by arrows 238, with respect to label media 20. Rollers 74*b* and 76*b* rotate, as indicated by arrows 240, and are responsible for moving label media 20. Plotter cutter 32 and end cutter 36 are appropriately positioned for selective end and plotter cutting of the label media.

Controller 250 (e.g., a microprocessor) is again shown in operative association, indicated by connections 252 and 254, with print head assembly 142 and cutting assembly 30 so as to ensure independent operation of each. Here, controller 250 controls positioning of print head 144 for printing to the label media as well as positioning of cutting assembly rollers in the non-cutting position as shown.

In a preferred embodiment, the controller can be programmed to control the print head assembly and the cutting assembly such that printing to and cutting of the label media does not occur simultaneously in the label printer-cutter. In another preferred embodiment, the platen roller can be used to drive the label media in the label printer-cutter during printing, cutting assembly rollers can be used to drive the label media in the label printer-cutter during cutting, and the controller is programmed to transfer primary driving responsibility of the label media between the platen roller and the cutting assembly rollers.

In a preferred embodiment, only one of printing to and cutting of the label media is possible at a specified time during operation of the label printer-cutter. In another preferred embodiment, the cutting assembly is operable to cut the label media only after the print head of the print head assembly has completed printing to the label media. In yet another preferred embodiment, the print head is unloaded from the label media prior to the cutting assembly effecting cutting of the label media. In still yet another preferred embodiment, the controller can be programmed to control the print head assembly and the cutting assembly such that printing to and cutting of the label media cannot occur simultaneously in the label printer-cutter.

In accordance with one aspect of the present invention, a method is disclosed for selectively printing to and cutting of a label media in a label printer-cutter. The method includes: printing to a label media using a print head assembly, cutting the label media using the cutting assembly, and using a controller that is in operable association with the print head assembly and the cutting assembly to control the print head assembly and the cutting assembly such that printing to and cutting of the label media does not occur simultaneously in the label printer-cutter.

It is contemplated that cartridges for holding and/or supplying one or both of the ribbon and/or label media supplies can be of the "re-usable" (also called "refillable") type, but preferably are of the "disposable" type. One example of a cartridge that can be used with the label printer-cutter described herein is more fully described in a co-pending U.S. patent application entitled "Ribbon Wiper", filed concurrently with the present application and which is fully incorporated by reference herein.

As used herein, the term "frame" has been used to refer to the label printer frame. Frame portions (e.g., cover frame portion, base frame portion, and the like), have been listed for purposes of clarification, and are not intended to limit the present invention, in any of its embodiments. As such "frame" can refer to the label printer frame in general, or to any of its frame portions, frame assemblies, frame subassemblies, alone or in combination.

Methods have been described and outlined in a sequential fashion. Still, elimination, modification, rearrangement, combination, reordering, or the like, of the methods is contemplated and considered within the scope of the appending claims.

In general, while the present invention has been described in terms of preferred embodiments, it is recognized that equivalents, alternatives, and modifications, aside from those expressly stated, are possible and within the scope of the appending claims.

What is claimed is:

1. A label printer-cutter comprising:

a frame;

a print head assembly connected to the frame, the print bead assembly including a print head for printing to a label media;

a cutting assembly connected to the frame, the cutting assembly comprising:

a cutter to cut the label media; and a pair of rollers connected to frame;

a roller positioning assembly in engagement with and for positioning the pair of cutting assembly rollers into one of a cutting position and a non-cutting position; and a controller in operative association with the print head assembly and the cutting assembly;

wherein the controller can be programmed to control the print head assembly and the cutting assembly such that printing by the print head to the label media corresponds to the pair of cutting assembly rollers being positioned by the roller positioning assembly into the non-cutting position, and cutting of the label media by the cutting assembly cutter corresponds to the pair of cutting assembly rollers being positioned by the roller positioning assembly into the cutting position.

2. The label printer-cutter of claim 1 wherein the print head is a thermal print head.

3. The label printer-cutter of claim 1 wherein the print head is a variably loadable print head.

4. The label printer-cutter of claim 1 wherein the cutting assembly further comprises a plotter cutter connected to the frame for plotter cutting the label media.

5. The label printer-cutter of claim 1 wherein the cutting assembly further comprises an end cutter connected to the frame for end cutting the label media.

6. The label printer-cutter of claim 1 wherein only one of printing to and cutting of the label media is possible at a specified time during operation of the label printer-cutter.

7. The label printer-cutter of claim 1 wherein the cutting assembly is operable to cut the label media only after the print head of the print head assembly has completed printing to the label media.

8. The label printer-cutter of claim 1 wherein the print head is unloaded from the label media prior to the cutting assembly effecting cutting of the label media.

9. A label printer-cutter comprising:

a frame;

a print head assembly connected to the frame, the print head assembly including a print head for printing to a label media;

wherein the print head assembly further comprises:

a print head lift cam connected to the frame; and a print head assembly pin in operative association with the print head lift cam, the pin housing a print head load spring;

wherein the load spring housed within the print head assembly pin can be compressed via rotation of the cam so as to transfer a media-specific load to the label media.

10. The label printer-cutter of claim 9 wherein the print head assembly further comprises:

a print head mount connected to the print head assembly pin; and a print head pivot pin;

wherein the print head pivot pin passes through, so as to pivotally connect, the print head assembly pin and the print head mount.

11. A label printer-cutter comprising:

a frame;

a print head assembly connected to the frame, the print head assembly including a print head for printing to a label media;

a cutting assembly connected to the frame, the cutting assembly for cutting of the label media; and a controller in operative association with the print head assembly and the cutting assembly;

wherein the controller can be programmed to control the print heads assembly and the cutting assembly such that printing to and cutting of the label media does not occur simultaneously in the label printer-cutter wherein the cutting assembly further comprises:

a cutting assembly frame connected to the frame;

a plotter cutter slide rail pivotally secured to the cutting assembly frame;

a plotter cutter connected to the plotter cutter slide rail for plotter cutting a label media;

an end cutter slide rail secured to the cutting assembly frame;

an end cutter connected to the end cutter slide rail for end cutting the label media; and a drive mechanism connected to the plotter cutter and the end cutter for driving at least one of the plotter cutter to perform a plotter cut to the label media and an end cutter to perform an end cut to the label media.

12. A label printer-cutter comprising:

a frame;

a print head assembly connected to the frame, the print head assembly including a print head for printing to a label media;

a cutting assembly connected to the frame, the cutting assembly for cutting of the label media; and a controller in operative association with the print head assembly and the cutting assembly;

wherein the controller can be programmed to control the print head assembly and the cutting assembly such that printing to and cutting of the label media does not occur simultaneously in the label printer-cutter wherein the cutting assembly further comprises:

a plotter cutter slide rail pivotally secured to the frame;

a plotter cutter connected to the plotter cutter slide rail for plotter cutting the label media;

an end cutter slide rail secured to the frame;

an end cutter connected to the end cutter slide rail for end cutting the label media; and a drive mechanism connected to the plotter cutter and the end cutter for driving at least one of the plotter cutter to perform a plotter cut to the label media and an end cutter to perform an end cut to the label media.

13. A label printer cutter comprising:

a frame;

a print head assembly connected to the frame, the print head assembly including a print head for printing to a label media;

a cutting assembly connected to the frame, the cutting assembly for cutting of the label media; and a controller in operative association with the print head assembly and the cutting assembly;

wherein the controller can be programmed to control the print head assembly and the cutting assembly such that printing to and cutting of the label media does not occur simultaneously in the label printer-cutter, wherein the cutting assembly includes a pair of rollers and wherein the printer-cutter further includes a roller positioning assembly comprising a slide plate for positioning the pair of rollers into one of a cutting position and a non-cutting position.

14. The label printer-cutter of claim 13 wherein the roller positioning assembly slide plate further comprises a plurality of slots for engaging the pair of cutting assembly rollers, at least one of the slots including a sloped portion for positioning the pair of cutting assembly rollers into the cutting and non-cutting positions.

15. The label printer-cutter of claim 14 wherein the roller positioning assembly further comprises a drive assembly connected to the frame, the drive assembly to accomplish at least one of driving at least one of the pair of cutting assembly rollers to effect positioning of the label media for cutting in the cutting assembly, and driving the slide plate to position the cutting assembly pair of rollers into the cutting and non-cutting positions.

16. The label printer-cutter of claim 15 wherein the roller positioning assembly further comprises a cam assembly connected to the drive assembly to drive the slide plate to position the cutting assembly pair of rollers.

17. A label printer-cutter comprising:

a frame;

a print head assembly connected to the frame, the print head assembly including a print head for printing to a label media;

a cutting assembly connected to the frame, the cutting assembly for cutting of the label media; and a controller in operative association with for print head assembly and the cutting assembly;

wherein the controller can be programmed to control the print head assembly and the cutting assembly such that printing to and cutting of the label media does not occur simultaneously in the label printer-cutter further comprising a platen roller to drive the label media in the label printer-cutter during printing and a pair of cutting assembly rollers to drive the label media in the label printer-cutter during cutting, and wherein the controller is programmed to transfer primary driving responsibility of the label media between the platen roller and the cutting assembly pair of rollers.

18. A label printer-cutter comprising:

a frame;

a print head assembly connected to the frame, the print head assembly including a print head for printing to a label media;

a cutting assembly connected to the frame, the cutting assembly comprising:

a cutter to cut the label media; and a pair of rollers connected to the frame;

a roller positioning assembly comprising a slide plate for positioning the pair of rollers into one of a cutting position and a non-cutting position; and a controller in operative association with the print head assembly, the cutting assembly and the roller positioning assembly;

wherein the controller ensures that printing to and cutting of the label media in the label printer-cutter are mutually exclusive.

19. The label printer-cutter of claim 18 wherein the print head is a thermal print head capable of printing a dot line to a label media.

20. The label printer-cutter of claim 18 wherein the cutter is one of an end cutter and a plotter cutter.

21. The label printer-cutter of claim 18 wherein the roller positioning assembly further comprises a drive assembly connected to the frame, the drive assembly to accomplish at least one of driving at least one of the pair of cutting assembly rollers to effect positioning of the label media for cutting in the cutting assembly, and driving the slide plate to position the cutting assembly pair of rollers into the cutting and non-cutting positions.

22. The label printer-cutter of claim 18 wherein the roller positioning assembly further comprises cam assembly connected to the drive assembly to move the slide plate to position the cutting assembly pair of rollers.

23. The label printer-cutter of claim 18 wherein only one of printing to and cutting of the label media is possible at a specified time during operation of the label printer-cutter.

24. The label printer-cutter of claim 18 wherein the cutting assembly is operable to cut the label media only after the print head at the print head assembly has completed printing to the label media.

25. A method for selectively printing to and cutting of a label media in a label printer-cutter, the method comprising:

printing to a label media using a print head assembly;

cutting the label media using a cutting assembly, the cutting assembly including a pair of rollers;

positioning the pair of rollers into one of a cutting position and a non-cutting position using a roller positioning assembly that is in engagement the pair of cutting assembly rollers; and using a controller that is in operable association with the print head assembly and the cutting assembly to control the print head assembly and the cutting assembly such that printing to the label media corresponds to the pair of cutting assembly rollers being positioned by the roller positioning assembly, into the non-cutting position, and cutting of the label media by the cutting assembly cutter corresponds to the pair of cutting assembly rollers being positioned by the roller positioning assembly into the cutting position.

26. A method for selectively printing to and cutting of a label media in a label printer-cutter, the method comprising:

printing to a label media using a print head assembly;

cutting the label media using the cutting assembly;

using a controller that is in operable association with the print head assembly and the cutting assembly to control the print head assembly and the cutting assembly such that printing to and cutting of the label media does not occur simultaneously in the label printer-cutter wherein the cutting assembly includes a pair of rollers and wherein the printer-cutter further includes a roller positioning assembly comprising a slide plate.

27. The method of claim 26 further comprising positioning the pair of rollers into one of a cutting position and a non-cutting position.

28. A method for selectively printing to and cutting of a label media in a label printer-cutter, the method comprising:

printing to a label media using a print head assembly;

cutting the label media using the cutting assembly;

using a controller that is in operable association with the print head assembly and the cutting assembly to control the print head assembly and the cutting assembly such that printing to and cutting of the label media does not occur simultaneously in the label printer-cutter, further comprising driving, using a platen roller, the label media during printing and driving, using a pair of cutting assembly rollers, the label media in during cutting.

29. The method of claim 28 further comprising transferring, using a programmed controller, primary driving responsibility of the label media between the platen roller and the cutting assembly pair of rollers.

30. A system for effecting mutually exclusive printing and cutting operations in a label printer-cutter, the system comprising:

a frame;

a label media supply to supply a label media;

an ink ribbon supply to supply a thermally-sensitive ink for application to the label media;

a print head assembly connected to the frame, the print head assembly including a thermal print head for printing a dot line using the thermally-sensitive ink to the label media;

a cutting assembly connected to the frame the cutting assembly comprising:

a cutter to cut the label media; and a pair of rollers connected to the frame;

a roller positioning assembly in engagement with and for positioning the pair of cutting assembly rollers into one of a cutting position and a non-cutting position; and a controller in operative association with the print head assembly and the cutting assembly;

wherein the controller can be programmed to control the print head assembly and the cutting assembly such that printing by the print head to the label media corresponds to the pair of cutting assembly rollers being positioned by the roller positioning assembly into the non-cutting position, and cutting of the label media by the cutting assembly cutter corresponds to the pair of cutting assembly rollers being positioned by the roller positioning assembly into the cutting position.

31. The system of claim 30 wherein only one of printing to and cutting of the label media is possible at a specified time during operation label printer-cutter.

32. The system of claim 30 wherein the cutting assembly is operable to cut the label media only after the print head of the print head assembly has completed printing to the label media.

33. The system of claim 30 wherein the label media supply is a label media supply cartridge.

34. The system of claim 33 wherein the label media supply cartridge is one of a disposable and a reusable label media supply cartridge.

35. The system of claim 30 wherein the ink ribbon supply is an ink ribbon supply cartridge.

36. The system of claim 35 wherein the ink ribbon supply cartridge is one of a disposable and a reusable ink ribbon supply cartridge.

37. A system for effecting mutually exclusive printing and cutting operations in a label printer-cutter, the system comprising:

a frame;

a label media supply to supply a label media;

an ink ribbon supply to supply a thermally-sensitive ink for application to the label media;

a print head assembly connected to the frame, the print head assembly including a thermal print head for a dot line using the thermally-sensitive ink to the label media;

a cutting assembly connected to the frame, the cutting assembly for cutting of the label media; and a controller in operative association with the print head assembly and the cutting assembly;

wherein the controller can be programmed to control the print head assembly and the cutting assembly such that printing to and cutting of the label media does not occur simultaneously in the label printer-cutter.

wherein the cutting assembly includes a pair of rollers and wherein the system further includes a roller positioning assembly comprising a slide plate for positioning the pair of rollers into one of a cutting position and a non-cutting position.

38. The system of claim 37 wherein the roller positioning assembly slide plate further comprises a plurality of slots for engaging the pair of cutting assembly rollers, at least one of the slots including a sloped portion for positioning the pair of cutting assembly rollers into the cutting and non-cutting positions.

39. The system of claim 38 wherein the roller positioning assembly further comprises a drive assembly connected to the frame, the drive assembly to accomplish at least one of driving at least one of the pair of cutting assembly rollers to effect positioning of the label media for cutting in the cutting assembly, and driving the slide plate to position the cutting assembly pair of rollers into the cutting and non-cutting positions.

40. The system of claim 39 wherein the roller positioning assembly further comprises cam assembly connected to the drive assembly to drive the slide plate to position the cutting assembly pair of rollers.

41. A system for effecting mutually exclusive printing and cutting operations in a label printer-cutter, the system comprising:

a frame;

a label media supply to supply a label media;

an ink ribbon supply to supply a thermally-sensitive ink for application to the label media;

a print head assembly connected to the frame, the print head assembly including a thermal print head for printing a dot line using the thermally-sensitive ink to the label media;

a cutting assembly connected to the frame, the cutting assembly for cutting of the label media; and a controller in operative association with the print head assembly and the cutting assembly;

wherein the controller can be programmed to control the print head assembly and the cutting assembly such that printing to and cutting of the label media does not occur simultaneously in the label printer-cutter further comprising a platen roller to drive the label media in the label printer-cutter during printing and a pair of cutting assembly rollers to drive the label media in the label printer-cutter during cutting, and wherein the controller is programmed to transfer primary driving responsibility of the label media between the platen roller and the cutting assembly pair of rollers.

42. A system for effecting mutually exclusive printing and cutting operations in a label printer-cutter the system comprising:

a frame;

a label media supply to supply a label media;

an ink ribbon supply to supply a thermally-sensitive ink for application to the label media;

a print head assembly connected to the frame, the print head assembly including a thermal print head for printing a dot line using the thermally-sensitive ink to the label media;

a cutting assembly connected to the frame, the cutting assembly for cutting of the label media; and a controller in operative association with the print head assembly and the cutting assembly;

wherein the controller can be programmed to control the print head assembly and the cutting assembly such that printing to and cutting of the label media does not occur simultaneously in the label printer-cutter;

wherein the print head is unloaded from the label media prior to the cutting assembly effecting cutting of the label media.

43. A label printer-cutter comprising:

a frame;

a print head assembly connected to the frame, the print head assembly comprising:

a print head lift cam connected to the frame;

a print head assembly pin in operative association with the print head lift cam, the assembly pin housing a print head load spring that can be compressed via rotation of the cam so as to transfer a media-specific load to the label media;

a print head mount connected to the print head assembly pin; and a print head pivot pin that passes through, so as to pivotally connect, the print head assembly pin and the print head mount; and a thermal print head connected to the print head mount, the print head for printing a dot line to the label media;

a cutting assembly connected to the frame, the cutting assembly comprising:

a plotter cutter slide rail pivotally secured to the frame;

a plotter cutter connected to the plotter cutter slide rail for plotter cutting the label media;

an end cutter slide rail secured to the frame;

an end cutter connected to the end cutter slide rail for end cutting the label media; and a drive mechanism connected to the plotter cutter and the end cutter for driving at least one of the plotter cutter to perform a plotter cut to the label media and an end cutter to perform an end cut to the label media; and a controller in operative association with the print head assembly and the cutting assembly;

wherein the controller can be programmed to control the print head assembly and the cutting assembly such that printing to and cutting of the label media cannot occur simultaneously in the label printer-cutter.

44. The label printer cutter of claim 43 wherein the cutting assembly includes a pair of rollers and wherein the printer-cutter further includes a roller positioning assembly comprising a slide plate for positioning the pair of rollers into one of a cutting position and a non-cutting position.

45. The label printer cutter of claim 44 wherein the roller positioning assembly slide plate further comprises a plurality of slots for engaging the pair of cutting assembly rollers, at least one of the slots including a sloped portion for positioning the pair of cutting assembly rollers into the cutting and non-cutting positions.

46. The label printer-cutter of claim 45 wherein the roller positioning assembly further comprises a drive assembly connected to the frame, the drive assembly to accomplish at least one of driving at least one of the pair of cutting assembly rollers to effect positioning of the label media for cutting in the cutting assembly, and driving the slide plate to position the cutting assembly pair of rollers into the cutting and non-cutting positions.

47. The label printer-cutter of claim 44 wherein the roller positioning assembly further comprises cam assembly connected to the drive assembly to drive the slide plate to position the cutting assembly pair of rollers.

48. The label printer-cutter of claim 43 further comprising a platen roller to drive the label media in the label printer-cutter during printing and a pair of cutting assembly rollers to drive the label media in the label print-cutter during cutting, and wherein the controller is programmed to transfer primary driving responsibility of the label media between the platen roller and the cutting assembly pair of rollers.

49. The label printer-cutter of claim 43 wherein only one of printing to and cutting of the label media is possible at a specified time during operation of the label printer-cutter.

50. The label printer-cutter of claim 43 wherein the cutting assembly is operable to cut the label media only after the print head of the print head assembly has completed printing to the label media.

51. The label printer-cutter of claim 43 wherein the print head is unloaded from the label media prior to the cutting assembly effecting cutting of the label media.

* * * * *